US006372093B1

(12) United States Patent
Brewer

(10) Patent No.: US 6,372,093 B1
(45) Date of Patent: Apr. 16, 2002

(54) ADJUSTABLE FOIL APPARATUS FOR PAPERMAKING MACHINE

(75) Inventor: John R. Brewer, Hillsboro, OR (US)

(73) Assignee: Wilbanks International, Inc., Hillsboro, OR (US)

( * ) Notice: Subject to any disclaimer, the term of this patent is extended or adjusted under 35 U.S.C. 154(b) by 0 days.

(21) Appl. No.: 09/843,561

(22) Filed: Apr. 26, 2001

(51) Int. Cl.[7] ..... D21F 1/54
(52) U.S. Cl. ..... 162/352; 162/374
(58) Field of Search ..... 162/352, 374, 162/354, 301, 363, 364

(56) References Cited

U.S. PATENT DOCUMENTS

| | | | | |
|---|---|---|---|---|
| 3,017,930 | A | | 1/1962 | Dunlap |
| 3,027,940 | A | | 4/1962 | Dunlap |
| 3,140,225 | A | | 7/1964 | Truxa |
| 3,201,308 | A | | 8/1965 | Goddard et al. |
| 3,220,920 | A | | 11/1965 | Truxa |
| 3,323,982 | A | | 6/1967 | Hill |
| 3,520,775 | A | | 7/1970 | Truxa |
| 3,535,201 | A | | 10/1970 | Reynolds et al. |
| 3,573,159 | A | | 3/1971 | Sepall |
| 3,576,716 | A | | 4/1971 | Reynolds et al. |
| 3,647,620 | A | | 3/1972 | Truxa |
| 3,874,998 | A | | 4/1975 | Johnson |
| 4,061,532 | A | | 12/1977 | Biondetti |
| 4,123,322 | A | | 10/1978 | Hoult |
| 4,162,937 | A | | 7/1979 | Corbellini |
| 4,184,915 | A | | 1/1980 | Metcalf |
| 4,334,958 | A | | 6/1982 | Baluha et al. |
| 4,416,731 | A | | 11/1983 | Pesonen et al. |
| 4,447,296 | A | * | 5/1984 | Cruse ..... 162/352 |
| 4,459,176 | A | | 7/1984 | Goodnow |
| 4,687,549 | A | | 8/1987 | Kallmes |
| 4,789,433 | A | | 12/1988 | Fuchs |
| 4,838,996 | A | | 6/1989 | Kallmes |
| 4,865,692 | A | | 9/1989 | Kade et al. |
| 5,011,577 | A | | 4/1991 | Hansen et al. |
| 5,061,347 | A | | 10/1991 | Bubik et al. |
| 5,089,090 | A | | 2/1992 | Hansen |
| 5,169,500 | A | | 12/1992 | Mejdell |
| 5,262,009 | A | | 11/1993 | Schiel et al. |
| 5,262,010 | A | * | 11/1993 | Bubik et al. ..... 162/354 |
| 5,387,320 | A | | 2/1995 | Jaakkola |
| 5,437,769 | A | | 8/1995 | Bando et al. |
| 5,690,792 | A | * | 11/1997 | Jaakkola ..... 162/352 |
| 5,830,322 | A | | 11/1998 | Cabrera y Lopez Caram et al. |

* cited by examiner

*Primary Examiner*—Karen M. Hastings
(74) *Attorney, Agent, or Firm*—Klarquist Sparkman, LLP

(57) ABSTRACT

An adjustable foil apparatus for papermaking machines is described in which a pair of rigid foil members are mounted in a pair and are pivotable about substantially parallel longitudinal axes in mirror image fashion to provide selected angularity therebetween. A common operating mechanism is attached to both of the adjustable angle foils in the pair, such that actuation of the operating mechanism produces concurrent mirror image pivoting of the foils in the pair.

19 Claims, 4 Drawing Sheets

ADJUSTABLE FOIL APPARATUS FOR PAPERMAKING MACHINE

FIELD OF THE INVENTION

This invention relates to adjustable foil apparatus for a papermaking machine, and more particularly to such apparatus which includes a pair of substantially rigid foils extending laterally of a conveyor path and mounted for pivoting about longitudinal axes in mirror image movement to produce desired control of material carried on the conveyor.

BACKGROUND

In the manufacture of paper it is necessary to control the flow of fluidized material along a conveyor and to draw water therefrom. This is done generally by providing a plurality of supports which underlie the conveyor and extend laterally of the conveyor path with spaces provided therebetween through which fluids may be drawn from the papermaking stock. In the past a variety of individually adjustable foils have been proposed to provide desired dewatering and other actions in the stock being carried by the traveling conveyor.

One form of an adjustable angle foil for papermaking machine is disclosed in U.S. Pat. No. 5,169,500, issued Dec. 8, 1992. Although this patent discloses a cam adjustable rigid foil, it speaks only to the use of individual foils which have their own independent orientation and are adjusted independently of other foils in the system.

It has been found that by coordinating the adjustment of a plurality of foils improved operation may be obtained.

SUMMARY OF THE DISCLOSURE

It is an object of the present disclosure to provide drainage foil apparatus for a papermaking machine in which a pair of foils for removing fluid from paper pulp stock are disposed adjacent each other and extend laterally of the path of an overlying conveyor, with supports and adjustment mechanism for the pair of foils being operable to produce concurrent pivoting of the foils in the pair about their respective longitudinal pivot axes to produce mirror image pivoting of the foils in the pair. In such system the foils in a pair may be selectively oriented, such that they operate together either to provide a substantially horizontal surface over which a conveyor moves, or they can be pivoted in mirror image fashion to provide either a shallow or more deeply configured V-shaped structure over which the conveyor moves.

Another object of the present disclosure is to provide such foil apparatus in which the foil angle adjustment mechanism is cam actuated in order to adjust the foil angle substantially uniformly across the entire length of the foil member.

A further object of the present disclosure is to provide such foil apparatus in which the cam actuation mechanism for one foil member in a pair is substantially a mirror image of the cam actuation mechanism of the other foil member in the pair, such that operation of the cam actuation mechanism for the pair may produce concurrent mirror image movement for the two foil members in the pair.

A still further object of the present disclosure is to provide control mechanism operatively connected to both of the foil members in a pair, with the control mechanism being operable to shift the two foil members in a pair longitudinally, with such longitudinal movement producing concurrent mirror image pivoting of the foil members in the pair about their respective longitudinal pivot axes.

An additional object of the present disclosure is to provide drainage foil apparatus for a papermaking machine in which multiple pairs of foils are provided, with the foils in each pair being pivotable in mirror image fashion relative to the other foil in its respective pair, to produce a selected angular relationship between such foils in a given pair, and a different angular relationship between the foils in another pair of foils in such system may be produced.

Yet another object of the present disclosure is to provide multiple pairs of adjustable foils disposed at different locations along the path of a papermaking conveyor, which pairs of foils may be disposed in different series of angular relationships relative to each other to provide desired actuation of material carried on the conveyor extending thereacross.

These and other objects of the present disclosure will become more fully apparent as the following description is read in conjunction with the drawings.

DESCRIPTION OF PREFERRED EMBODIMENTS

Figure 1:
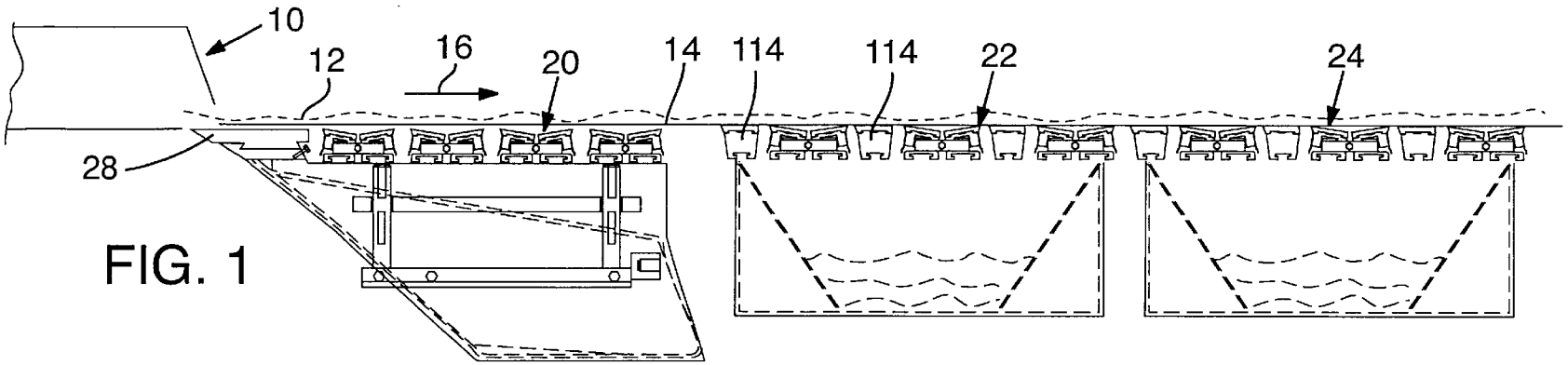
FIG. 1 is a somewhat schematic side elevation view of a portion of a papermaking machine showing examples of variable dewatering devices including apparatus according to the present disclosure.

Referring to FIG. 1, the initial portion of a papermaking machine is illustrated including a head box 10 which delivers a liquid slurry of paper pulp and water referred to as "paper stock" 12 onto the upper surface of a conveyor, or wire, 14 driven along a path in the direction of arrow 16. The conveyor, or wire, includes a porous conveyor belt in the form of a woven screen, or "wire," which may be made of stainless steel, bronze, or other suitable metal, or of a woven fabric of synthetic plastic, such as polyester.

The paper stock is carried in the direction of arrow 16 over apparatus including dewatering sections where water is removed from the paper stock. Three such dewatering sections are indicated generally at 20, 22, and 24, respectively. Sections 20, 22 are illustrated in greater detail in FIGS. 2 and 3 and another style of dewatering section is illustrated in an enlarged form at 26 in FIG. 3.

Figure 2:
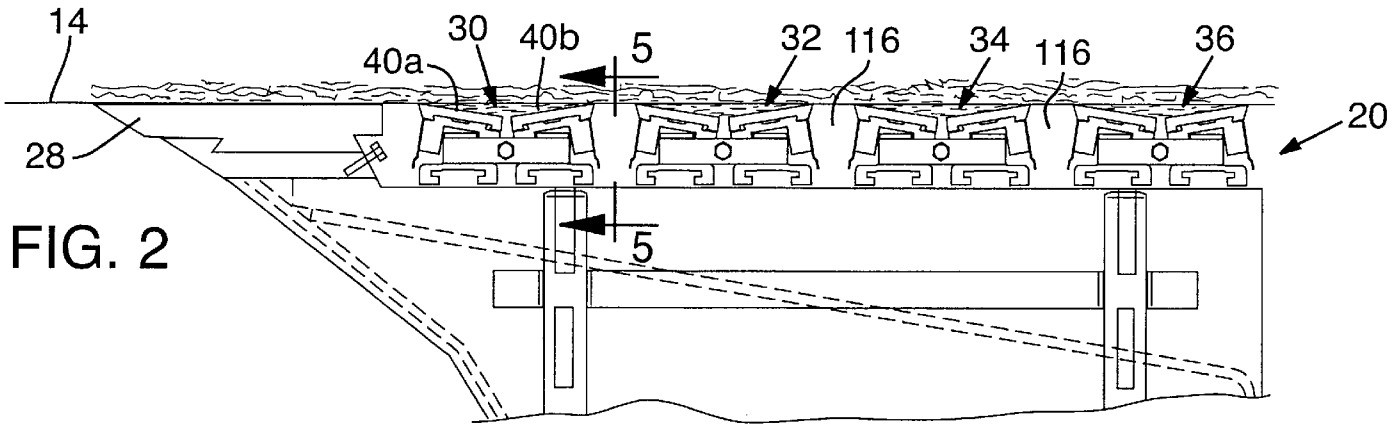
FIG. 2 is an enlarged side elevation view of a first dewatering section of the apparatus.

Referring to FIGS. 1 and 2, on being dispensed from head box 10 the paper stock 12 initially resides on a portion of the conveyor 14 supported on a forming board 28. The paper stock then is conveyed across the surface of a plurality of dewatering units as indicated generally at 20, 22, 24 which have a plurality of foils provided on their upper surface, as will be described in greater detail below. Some of these foils may be mounted stationarily within the system, whereas others are mounted for pivoting about longitudinal axes which extend laterally of the path of the conveyor. Both the stationary and variable angle foils act as dewatering devices which remove water from the paper stock as it is formed and conveyed across these elements as it is carried on wire 14.

The variable angle foils each engage the bottom surface of a conveyor at a small foil angle, in a range of about 0 to 6 degrees, which produces a selected vacuum below the conveyor belt to draw water from the paper stock. Adjustment of the angles of the foils controls the water removal rate of the foil and such removed water then drains through the dewatering sections and is disposed of. The foils are variable in height, as is known in previous papermaking machines, and are variable in angularity as will be described further below, both to provide the desired drawing of water from the paper stock and undulation and turbulence of the paper stock to form the paper sheet and to assist in removing water therefrom.

Referring to FIG. 2, here section 20 comprises four sets, or pairs, of adjustable angle foils 30, 32, 34, and 36. Each of these are substantially similar, and thus only one will be described in detail. Such a set, or pair, of foils indicated generally at 30 is illustrated in greater detail in FIGS. 5, 6, 7A, and 7B.

Apparatus 30 includes a pair of elongate adjustable foil members 40A, 40B which are substantially mirror images of each other and are disposed closely adjacent each other. These two foil members extend laterally of the path of conveyor 14 and support the full width of the conveyor. Foil members 40A, 40B are substantially mirror images of each other, and thus like parts, or portions, thereof will be given generally the same number, with an A or B suffix to denote which foil member the part, or portion, is associated with.

Figure 5:
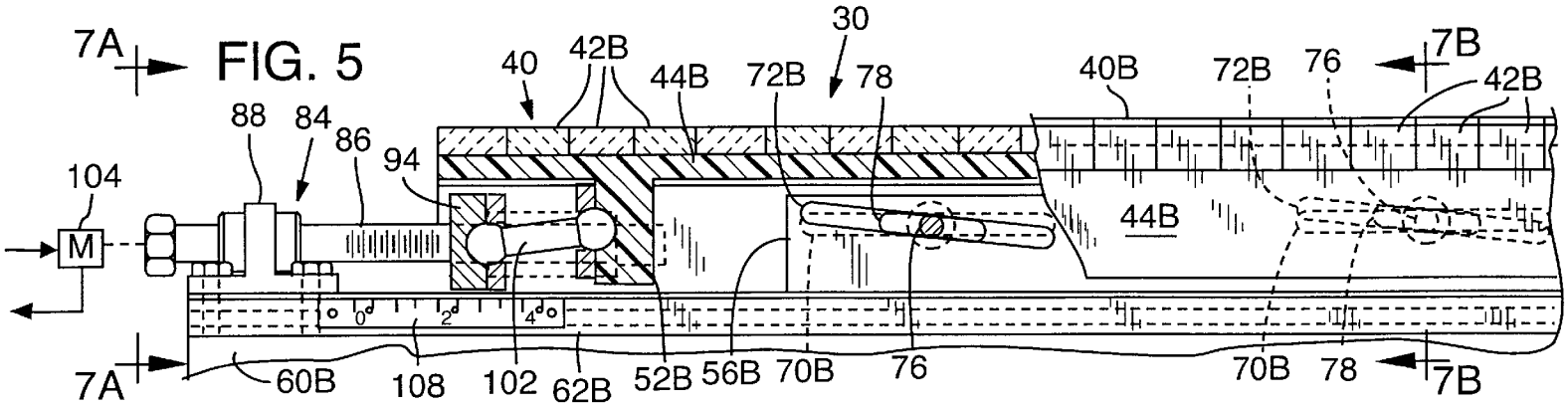
FIG. 5 is an enlarged side elevation view of an end portion of a pair of dewatering elements taken generally along the line 5—5 in FIG. 2 with portions broken away.
Figure 6:
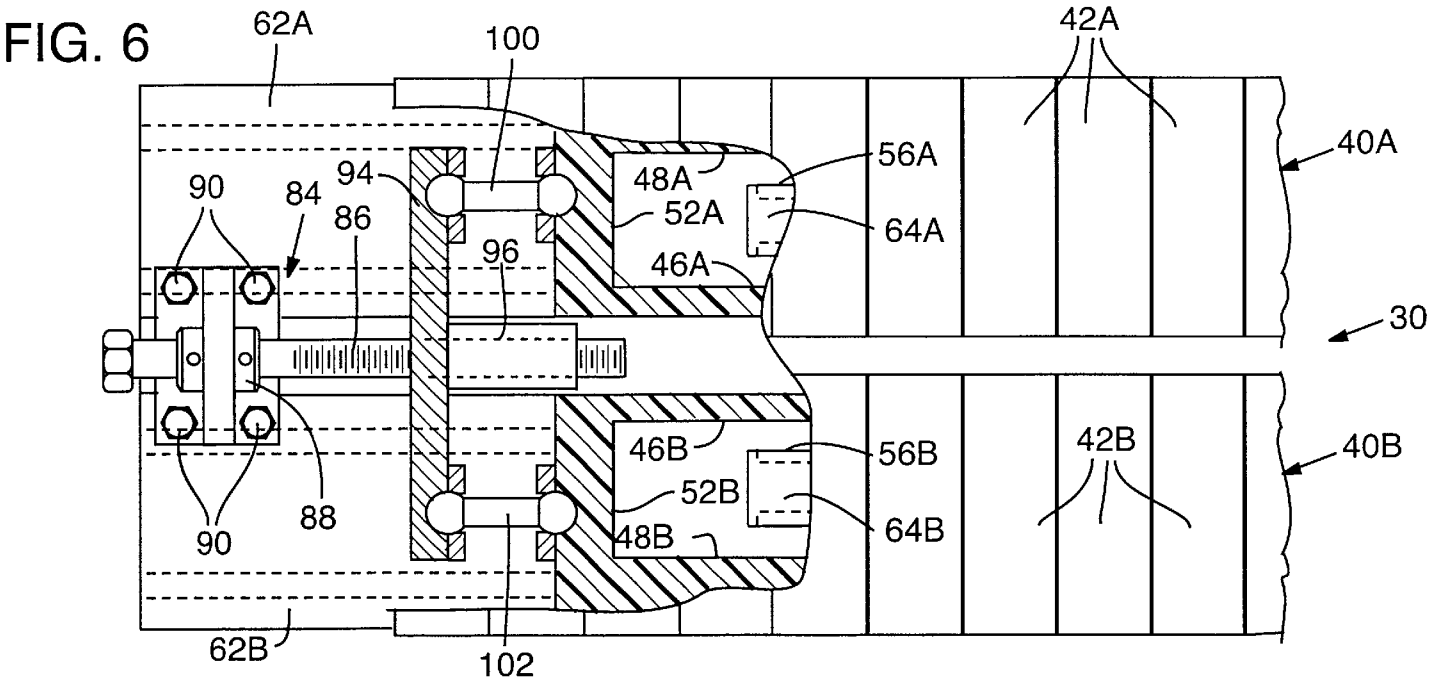
FIG. 6 is a top plan view of the apparatus illustrated in FIG. 5.
Figure 7A:
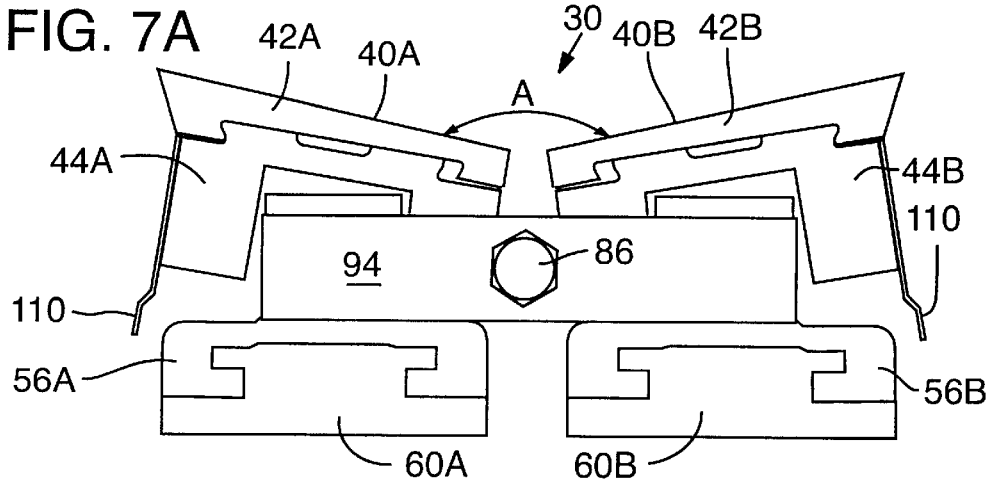
FIG. 7A is an end view taken generally along the lines 7A—7A in FIG. 5.
Figure 7B:
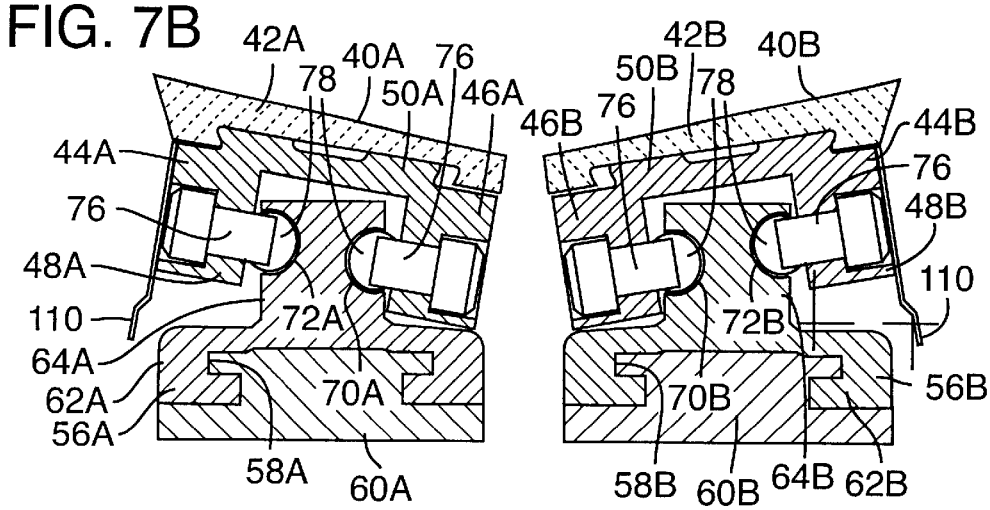
FIG. 7B is a cross sectional view taken generally along the line 7B—7B in FIG. 5.

In one embodiment, as illustrated in FIGS. 5–7B, the foil members include a plurality of rigid foil segments 42A, 42B of a suitable hard wear-resistant ceramic material, such as aluminum oxide, or other hard abrasive resistant material. The foil segments are fixedly mounted on the top of a foil support member 44A, 44B, which, as viewed in cross section in FIG. 7B, has an inverted U-shaped cross section throughout the majority of its length. This U-shaped cross section has downwardly depending inner legs, or sides, 46A, 46B and outer legs, or sides, 48A, 48B. The sides of foil members 40A, 40B which are closest to each other and facing, as shown in FIGS. 6 and 7B, will be referred to herein as the inner sides, whereas the sides facing outwardly, and away from each other will be referred to as the outer sides. The foil support members may be made of a fiberglass reinforced plastic material and have a length which extends fully across the width of conveyor 14. The upper portion 50A, 50B of the support member is provided with a dovetail projection on the top surface thereof which extends into a dovetail slot in the bottom of each of the ceramic segments 42A, 42B and is bonded thereto by a thermal-setting bonding material, such as an epoxy resin.

As is best seen in FIGS. 5 and 6, connector portions 52A, 52B extend between and interconnect legs 46A, 48A, and 46B, 48B, respectively.

Each foil support member 44A, 44B is coupled to an elongate foil mounting base 56A, 56B by means of sets of cam slots and cam follower projections riding in said cam slots as will be described below.

Each foil mounting base 56A, 56B is an elongate member extending laterally of the path of the conveyor and having a generally inverted T-shaped cross section throughout a major portion of its length, as best illustrated in FIG. 7B. The foil mounting base is secured to a machine frame in a conventional manner by T-shaped slots 58A, 58B in the bottom thereof into which a T-shaped bar, or rail, 60A, 60B is inserted when the foil mounting base is installed on the papermaking machine. The substantially horizontally disposed bottom portion 62A, 62B has a greater length than foil members 40A, 40B, whereas upstanding central portions 64A, 64B are shorter than foil members 40A, 40B. As best seen in FIGS. 5 and 6 central portions 64A, 64B terminate short of cross connector portions 52A, 52B of foil support members 44A, 44B, respectively.

Referring to FIGS. 5 and 7B, the upstanding central portions 64A, 64B of foil mounting bases 56A, 56B have inner cam slots 70A, 70B formed in their inwardly facing sides, and outer cam slots 72A, 72B formed in their outwardly facing sides. As is seen in the broken away portions of FIG. 5, there are multiple series of cam slots 70A, 70B, 72A, 72B along the lengths of the foil members. Slots 70A, 70B are all substantially parallel to each other and substantially horizontally disposed or at a very low angle to the horizontal. Slots 72A, 72B are all substantially parallel to each other and as is best seen in FIG. 5, are disposed at a greater angle to the horizontal than are slots 70A, 70B.

A plurality of cam follower holding pins 76 extend through accommodating bores in legs 46A, 46B, 48A, 48B and have either cam follower ball heads or rods 78 secured thereto. These cam followers 78 are received in their respective slots 70A, 70B, 72A, 72B to support their respective foil members.

When the foil support members 44A, 44B slide longitudinally during adjustment of the foil angle as will be described below, the varying angles at which the cam slots are disposed will cause the foil members 40A, 40B to pivot, or rotate, about longitudinal pivot axes in mirror image fashion relative to each other.

Longitudinal movement of the foil members is produced by control mechanism indicated generally at 84 which is operatively connected to the foil members and is actuatable to shift them longitudinally relative to the base member a predetermined amount to concurrently adjust the pair of foil members in mirror image movement. The control mechanism includes a screw 86 which is rotatably mounted in a bearing 88 which is secured to rails 62A, 62B by bolts 90. An operator head 94 has an internally threaded cylindrical portion 96 threadably received on screw 86 such that rotation of the screw causes operator head 94 to move laterally of the conveyor (to the right and left as viewed in FIGS. 5 and 6), and longitudinally relative to the foils. A first swivel connector 100 operatively connects one end of operator head 94 to foil member 40A and a second swivel connector 102 operatively connects the opposite end of operator head 94 to foil member 40B. The swivel connectors are substantially rigid elements, which have ball swivel heads coupled to the operator head and their respective foil members, such that shifting of the operator head laterally of the conveyor produces corresponding and concurrent shifting of the foil members in said directions. The ball end connections permit the foil members to pivot about their longitudinal pivot axes while being shifted longitudinally by the control mechanism.

Further, screw 86 may be connected to a motor 104 which is operated by various control apparatus to vary the positions of the foil members to produce selected operation during papermaking.

Explaining operation of the apparatus thus described, the tops of foil members 40A, 40B may be substantially horizontally disposed initially. For example, the tops of foil segments 42A, 42B shown in FIGS. 7A, 7B would lie in a substantially common horizontal plane. At this point they would have substantially a 180 degree included angle A therebetween. Upon actuation of control mechanism 84, as screw 86 is rotated head 94 shifts laterally of the conveyor, or longitudinally of foil members 40A, 40B causing their cam followers 78 to move longitudinally in cam slots 70A, 70B, 72A, 72B. This causes controlled mirror image pivoting of the connected pair of foil members to relatively inclined positions such as illustrated in FIGS. 7A, 7B. The actuation is such that one set of cam slots an cam follower projections (i.e. 70A, 78 for foil 40A and 70B, 78 for foil 40B) control vertical movement of the inwardly facing longitudinal edges of foils 40A, 40B. Similarly the other set of cam slots and cam follower projections (i.e. 72A, 72B, 78) control vertical movement of the outwardly facing edges of foils 40A, 40B. The angular relation of each foil member to the horizontal may range preferably between 0 degrees and 6 degrees, such that the included angle A therebetween may be in a range from 168 to 180 degrees.

As illustrated in FIG. 5, an indicator scale 108 is provided on the support and an angle pointer, such as provided by an end of the foil base member would indicate the angle at which the foils are adjusted.

Referring to FIGS. 7A, 7B a pair of plate shields 110 are mounted on the outer sides of the foil members and have lower portions which extend downwardly into a region adjacent the horizontal portion of base member 56A, 56B. These shields inhibit debris from entering the space between the foil member and its underlying base.

Figure 10:
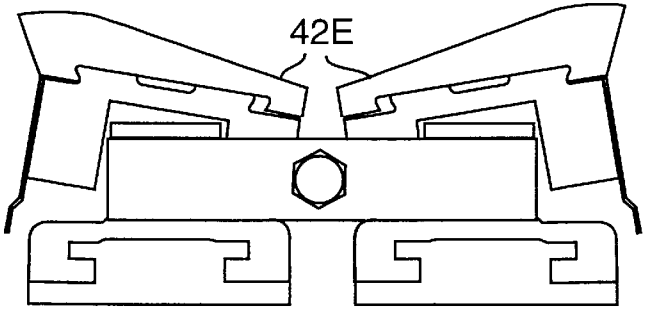
FIGS. 8–10 are illustrations, generally similar to FIG. 7A, but with differing top surface contours on the dewatering apparatus.
Figure 8:
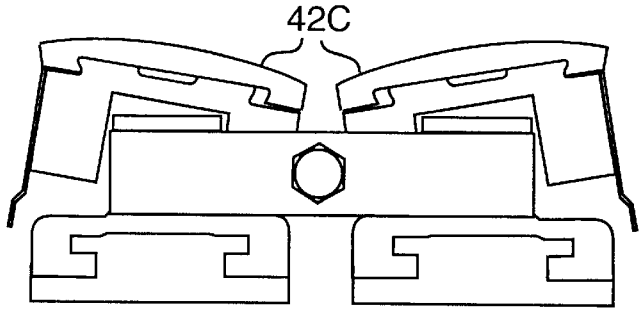
Figure 9:
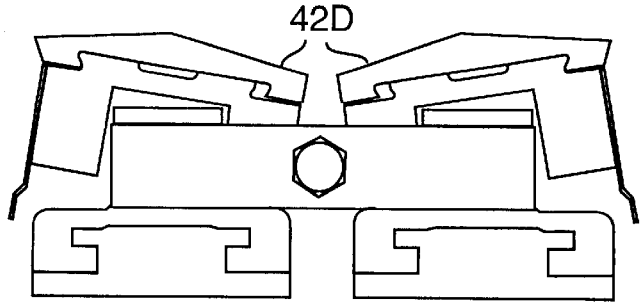

FIGS. 8, 9, and 10 illustrate apparatus similar to that previously described. However, in each of these the foil segments noted 42C, 42D, 42E, respectively, have a different upper cross sectional contour to form a somewhat different action during the papermaking process. However, they still provide ganged pairs of foils members which are pivoted, or tilted, in mirror image fashion as previously described.

Figure 3:
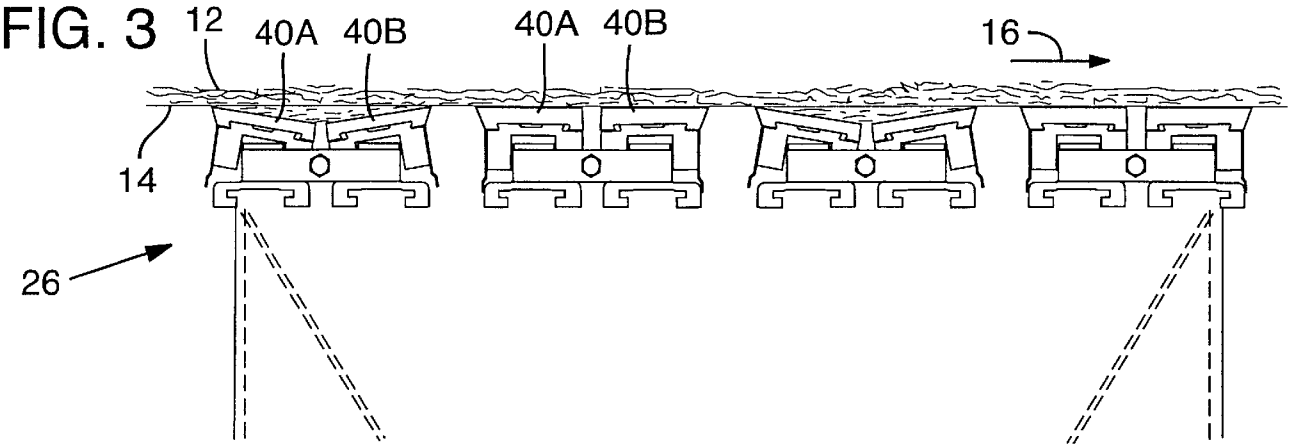
FIG. 3 is an enlarged side elevation view of a second dewatering section of such apparatus.
Figure 4:
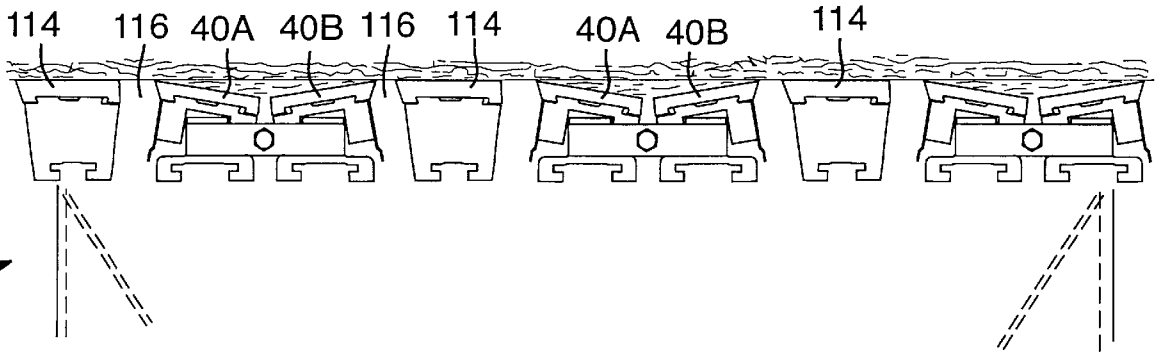
FIG. 4 is an enlarged side elevation view of a third dewatering section of such apparatus.

Referring to FIG. 4, it will be seen that sets, or pairs, of moveable foils may be interspersed with individual, or non-paired foils 114 with fluid flow spaces, or passages, 116 extending therebetween. Foils 114 may be stationary or may be angularly adjustable. Referring to FIG. 3, it will be seen that during operation, and to produce a desired result during the papermaking process, various pairs of foil members spaced at different positions upstream and downstream in the conveyor are tilted at different angles to provide desired operation. Some pairs of foils may be positioned with their upper surfaces disposed substantially horizontally, while others are tilted toward each other to form selected depth V-shaped configurations between foils in a pair.

In the process of making paper a mixture of water and fibrous pulp called "paper stock" is dispensed onto a porous conveyor web called the wire or fabric. At this point the major portion of the paper stock is water and only a very minor portion is fiber. As the paper stock travels on the conveyor, water is continuously being drained from the stock. As a result, the paper stock begins to thicken and form a paper sheet. Without sufficient agitation of the mixture, the fiber in the paper stock tends to clump, or flock, together. The formation of flocks, or clumps, in a sheet is detrimental to the uniform quality of the paper, causing an inconsistent appearance in the sheet. This is prevented by agitating the paper stock by producing turbulence in the stock.

Agitation of the paper stock is produced by the dewatering elements below the conveyor with a desired geometry relative to the conveyor to cause turbulence in the sheet. Foils, as described above, support the conveyor and help to remove water from the sheet. The basic foil as shown in FIG. 7A, 7B has a leading edge that scrapes water off the underside of the conveyor, supports the conveyor, and pulses a small amount of water back up into the fabric. The water that is pushed back up into the fabric causes an upward pressure pulse. Behind the leading edge of the foil, it is common for the upper surface of the foil to form a diverging angle away from the conveyor. This diverging angle is known as the foil angle. The foil angle causes a low pressure area to form under the wire which causes water to be pulled from the sheet. After the wire passes the angled foil the lowered pressure is released which causes a small pulse in the sheet. The pulsing thus produced is a primary means to break up flocks, or clumps, that are trying to form in the sheet.

It has been found that providing a pair of ganged foil members which may be pivoted in mirror image fashion to provide a somewhat V-shaped combined configuration will produce improved papermaking. By increasing, or decreasing, the angularity of the ganged pair of foils, the magnitude of the pulse may be varied as desired.

Many paper machines produce a range of paper grades. As the grades, and thus the weight, of the paper sheet changes, the magnitude of the pressure pulses required also changes. In the past, changing blades has been a difficult and time-consuming process. The typical foil, or blade, is 200 to 400 inches long and replacement can require substantial down time for the machine.

With the present invention wherein a pair of foils are capable of being adjusted concurrently in mirror image fashion to produce a variety of pulsing, or other papermaking characteristics, it is a simple matter, even while a machine is operating, to actuate the control mechanism which shifts the foils laterally of the conveyor, thus to move the cam followers in the cam slots and produce concurrent pivoting of the foil members in mirror image fashion to produce a desired angularity therebetween.

Where multiple ganged pairs of foils are disposed along the conveyor line, different pairs may have different relative angularity configurations to produce differing wave forms and actuation of the paper stock as it is carried along the conveyor. Further, by inter-mixing foils and foil pairs disposed at differing selected angularity along the conveyor path a variety of selected wave forms may be produced to provide desired actuation of the paper stock on the conveyor.

It will be obvious to those having ordinary skill in the art that changes may be made in the above-described description of certain preferred embodiments thereof. Therefore, the scope of the present invention should be determined by the following claims.

What is claimed is:

1. Drainage foil apparatus for a papermaking machine comprising a pair of foils for removing fluid from paper pulp stock carried by a conveyor along a path across said foils, each foil including an elongate rigid foil member having an upper surface comprising a hard wear resistant material, the foil members in said pair being disposed adjacent each other and extending laterally of said path, mountings supporting each of said rigid foil members on base members structured to enable pivoting of each of said foil members about a longitudinal pivot axis for the member which is substantially parallel to a longitudinal pivot axis for the other foil member, and foil angle adjustment mechanism coupled to said pair of foils operable to produce concurrent pivoting of said pair of foils about their respective pivot axes in mirror-image movement.

2. The apparatus of claim 1, wherein said foils are mounted for pivoting to positions in a range of from 0 degrees to 6 degrees from the horizontal to produce an included angle between the upper surfaces of the foils in a range of from 168 degrees to 180 degrees.

3. The apparatus of claim 1, wherein said foil angle adjustment mechanism for each foil comprises cam actuation mechanism having a first set of cam slots and cam follower projections in said cam slots, said first set being spaced along one side of the base member extending beneath the foil member, said foil member being mounted on said base member by said cam slots and projections for longitudinal movement relative to said base member so that longitudinal movement of a foil member relative to said base member causes the foil member to pivot to thereby change the foil angle, and control mechanism coupled to said pair of foils for longitudinally moving said pair of foils concurrently relative to the base member a predetermined amount to concurrently adjust said pair of foil members in mirror-image movement.

4. The apparatus of claim 3, wherein the base members for the pair of foils have a first set of sides facing each other and a second set of sides facing away from each other, and said first set of cam slots and cam follower projections for said pair of foils are located on one of said sets of sides of the base members.

5. The apparatus of claim 4, wherein said first set of cam slots for one of the foils in said pair of foils are substantially parallel to said first set of cam slots for the other of the foils in said pair of foils.

6. The apparatus of claim 4, wherein said foil adjustment mechanism for each foil further comprises a second set of cam slots and cam follower projections in said cam slots, said second set being spaced along a side of the base member opposite its said one set of sides beneath the foil member, with said second set not being substantially parallel to said first set, such that said first set controls vertical movement of one longitudinal edge of said foil and the second set controls vertical movement of the opposite longitudinal edge of said foil upon longitudinal movement of the foil relative to the base member to produce selected height and pivot control of the foil as it is moved longitudinally.

7. The apparatus of claim 3, wherein said control mechanism comprises a head coupled to both of said foil members in said pair, said head being mounted for movement in a direction paralleling the longitudinal axes of said pair of foils, and an operator connected to said head operable upon actuation to move said head and said foils coupled thereto concurrently in a direction longitudinally of said foils.

8. The apparatus of claim 7, wherein a swivel connector operatively connects said head to one of said foils in said pair, and a second swivel connector operatively connects said head to the other of said foils in said pair, said connectors permitting said foils to pivot relative to said head upon being shifted longitudinally with movement of the head.

9. The apparatus of claim 7, wherein said operator comprises a screw mechanism.

10. The apparatus of claim 1, wherein the foils in said pair are spaced apart to provide a fluid flow space therebetween.

11. Drainage foil apparatus for a papermaking machine comprising a first pair of foils and a second pair of foils for removing fluid from paper pulp stock carried by a conveyor along a path across said foils, said second pair of foils being positioned downstream along said conveyor path from said first pair of foils, each foil including an elongate rigid foil member having an upper surface comprising a hard wear resistant material, the foil members in said first pair being disposed adjacent each other and extending laterally of said path, and the foil members in said second pair being disposed adjacent each other and extending laterally of said path, mountings supporting each of said rigid foil members on base members structured to enable pivoting of each of said foil members about a longitudinal pivot axis for the member which is substantially parallel to a longitudinal pivot axis for the other foil member in said pair, first foil angle adjustment mechanism coupled to the foils in said first pair operable to produce concurrent pivoting of said foils in said first pair about their respective pivot axes in mirror-image movement to a selected angular relationship to each other, and second foil angle adjustment mechanism coupled to the foils in said second pair operable to produce concurrent pivoting of said foils in said second pair about their respective pivot axes in mirror-image movement to a selected angular relationship to each other different from the angular relationship of said foils in said first pair.

12. The apparatus of claim 11, wherein said foils in a pair are mounted for pivoting to positions in a range of from 0 degrees to 6 degrees from the horizontal to produce an included angle between the upper surfaces of the foils in a range of from 168 degrees to 180 degrees.

13. The apparatus of claim 11, wherein said foil angle adjustment mechanism for each foil comprises cam actuation mechanism having a first set of cam slots and cam follower projections in said cam slots, said first set being spaced along one side of the base member extending beneath the foil member, said foil member being mounted on said base member by said cam slots and projections for longitudinal movement relative to said base member so that longitudinal movement of a foil member relative to said base member causes the foil member to pivot to thereby change the foil angle, and control mechanism coupled to said foils in a pair for longitudinally moving said pair of foils concurrently relative to the base member a predetermined amount to concurrently adjust said pair of foil members in mirror-image movement.

14. The apparatus of claim 13, wherein the base members for a pair of foils have a first set of sides facing each other and a second set of sides facing away from each other, and said first set of cam slots and cam follower projections for said pair of foils are located on one of said sets of sides of the base members.

15. The apparatus of claim 14, wherein said first set of cam slots for one of said foils in one pair of foils are substantially parallel to said first set of cam slots for the other of said foils in said one pair of foils.

16. The apparatus of claim 14, wherein said foil adjustment mechanism for each foil in a pair further comprises a second set of cam slots and cam follower projections in said cam slots, said second set being spaced along a side of the base member opposite its said one set of sides beneath the foil member, with said second set not being substantially parallel to said first set, such that said first set controls vertical movement of one longitudinal edge of said foil and the second set controls vertical movement of the opposite longitudinal edge of said foil upon longitudinal movement of the foil relative to the base member to produce selected height and pivot control of the foil as it is moved longitudinally.

17. The apparatus of claim 13, wherein said control mechanism comprises a head coupled to both of said foil members in a pair, said head being mounted for movement in a direction paralleling the longitudinal axes of said pair of foils, and an operator connected to said head operable upon actuation to move said head and said foils coupled thereto concurrently in a direction longitudinally of said foils.

18. The apparatus of claim 17, wherein a swivel connector operatively connects said head to one of said foils in a pair, and a second swivel connector operatively connects said head to the other of said foils in a pair, said connectors permitting said foils to pivot relative to said head upon being shifted longitudinally with movement of the head.

19. Drainage foil apparatus for a papermaking machine comprising a first pair of foils and a second pair of foils for removing fluid from paper pulp stock carried by a conveyor along a path across said foils, said second pair of foils being spaced downstream along said conveyor path from said first pair of foils, each foil including an elongate rigid foil member having an upper surface comprising a hard wear resistant material, the foil members in said first pair being disposed adjacent each other and extending laterally of said path, and the foil members in said second pair being disposed adjacent each other and extending laterally of said path, mountings supporting each of said rigid foil members on base members structured to enable pivoting of each of said foil members about a longitudinal pivot axis for the member which is substantially parallel to a longitudinal pivot axis for the other foil member in said pair, first foil angle adjustment mechanism coupled to the foils in said first pair operable to produce concurrent pivoting of said foils in said first pair about their respective pivot axes in mirror-image movement to a selected angular relationship to each other, second foil angle adjustment mechanism coupled to the foils in said second pair operable to produce concurrent pivoting of said foils in said second pair about their respective pivot axes in mirror-image movement to a selected angular relationship to each other different from the angular relationship of said foils in said first pair, and a non-paired foil extending laterally of said path interposed in said space between said first and second pairs of foils with fluid flow spaces provided between said first pair of foils and said non-paired foil and between said non-paired foil and said second pair of foils.

* * * * *